United States Patent [19]

Venot

[11] Patent Number: 4,481,759

[45] Date of Patent: Nov. 13, 1984

[54] PROCESS AND DEVICE FOR MAKING SPUN YARNS COMPRISING A CORE

[75] Inventor: Jean Venot, Roanne, France

[73] Assignee: ASA S.A., Villeurbanne, France

[21] Appl. No.: 506,129

[22] Filed: Jun. 20, 1983

[30] Foreign Application Priority Data

Jun. 29, 1982 [FR] France ..... 82 11615

[51] Int. Cl.[3] ..... D02G 3/36; D01H 1/12

[52] U.S. Cl. ..... 57/5; 57/6

[58] Field of Search ..... 57/5, 6, 11, 12, 401, 57/327

[56] References Cited

U.S. PATENT DOCUMENTS 4,130,983 12/1978 Dammonn et al. ..... 57/5

4,241,574 12/1980 Turk et al. ..... 57/5 X 4,274,250 6/1981 Lippmann ..... 57/5

*Primary Examiner*—Donald Watkins

*Attorney, Agent, or Firm*—Parkhurst & Oliff

[57] ABSTRACT

The present invention relates to a process for making a core spun yarn, wherein elementary fibres are projected onto a yarn, the yarn being subjected to the action of a false twist spindle. The projection of the fibres is obtained by means of a mobile guiding surface on which the fibres are delivered tangentially and are maintained paralleled and flat. Furthermore, the core is delivered tangentially on the paralleled fibres obliquely and in the direction of displacement of said fibres. The invention also relates to a device for carrying out this process.

12 Claims, 8 Drawing Figures

PROCESS AND DEVICE FOR MAKING SPUN YARNS COMPRISING A CORE

The present invention relates to an improvement in spinning techniques, enabling spun yarns of fibres comprising an internal core to be produced, which will be hereinafter referred to as "core spun yarns".

It relates more particularly to an improvement made to the technique forming the subject matter of the French Patent published under No. 497 481.

Said document describes a technique which generally consists in:

delivering a yarn intended to form the internal core, passing this yarn in tangential contact with a mobile surface (carding drum) on which elementary fibers are maintained paralleled and flat, said yarn passing tranversely with respect to said surface;

communicating to said core yarn a twist which tends to extend back over the mobile surface supporting the elementary fibres, this twist being communicated by a member acting intermittently so that the yarn formed may untwist automatically and instantaneously, this rapid rotation of the yarn in reverse direction having no effect on the fibres already wound thereon.

It will be readily appreciated that, although such a process may enable a spun yarn of fibres comprising a core to be obtained, it does not allow high production speeds and, in particular, does not lead to good quality yarns since these fibres are not really bonded to the core but form to some exent a felt therearound, as indicated on page 3, lines 80 to 95 of the description of the above-mentioned Patent. These drawbacks may explain the fact that, to Applicants' knowledge, such a technique has not been used industrially.

Now, an improvement to the above process has been found, and this forms the subject matter of the present invention, which not only simplifies working thereof and allows very high production speeds, but which also enables any type of fibres to be treated equally well, particularly wool fibres (or fibres presenting similar hooking properties), materials which have hitherto been difficult to employ. Finally, the process according to the invention makes it possible to obtain a very good cohesion of the fibrous surface with the internal core, as well as core spun yarns presenting very regular textile characteristics.

The invention generally relates to an improvement to the process according to French Pat. No. 497 481 recalled hereinabove, said improvement being characterised in that:

the passage of the core yarn on the paralleled fibres is effected obliquely with respect to the surface supporting said fibres, this in their direction of displacement;

the twist communicated to the yarn is given by a false twist spinde, acting permanently on said yarn and which is disposed downstream of the mobile surface supporting the fibres.

In the following description, the mobile surface on which the elementary fibres are maintained paralleled and flat will be referred to as "mobile guiding surface".

According to the invention, the fibres may be maintained in paralleled form, flat on the mobile guiding surface either by subjecting said surface to a suction or, preferably, by using a surface which presents a surface state ensuring maintenance of the fibres by simple contact, or even by combining these two possibilities.

Several types of devices may be used for carrying out the process according to the invention.

The guiding surface may thus be in the form of a cylindrical drum, a drum in the form of a hyperboloid, an endless belt or any other equivalent member.

If the fibres are maintained on this guiding surface under the action of a phenomenon of suction, the surface will be perforated or porous and will be either in the form of a drum or in the form of an endless belt.

According to the preferred embodiment of the invention, whereby the fibres are maintained on the guiding surface by simple mutual contact, the surface will preferably be coated with a material facilitating adherence of the fibres, for example a material similar to a velvet. It might possibly be envisaged to use a surface having the structure of a brush.

However, whatever the surface used, it is indispensable not only that the fibres be maintained paralleled in the form of a band but also that the yarn intended to form the core be conducted tangentially to said band of fibres, in secant fashion, obliquely in the direction of displacement of the fibres.

The invention will be more readily understood on reading the following description with reference to the accompanying drawings, in which:

FIG. 1 schematically illustrates, in side view, a work position of a machine carrying out the process according to the invention for making a core spun yarn.

Figure 1:
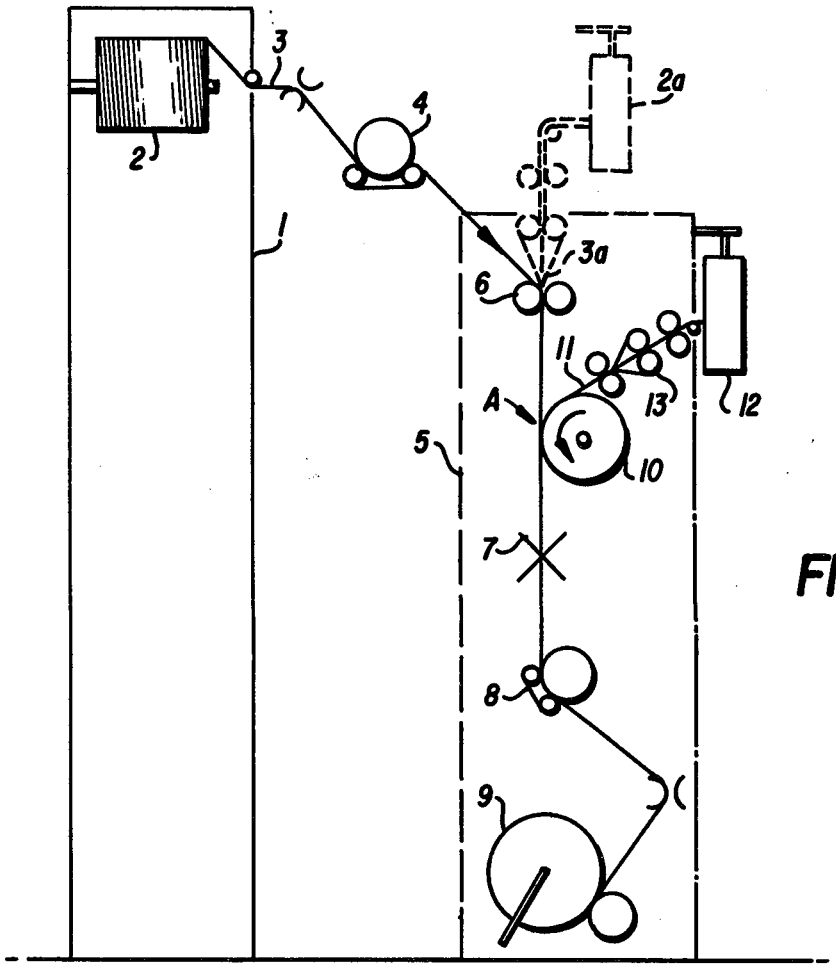

Referring now to the drawings, FIG. 1 illustrates in side view a work position of a machine for carrying out the process according to the invention, i.e. for making real core spun yarns in one step.

This installation comprises a storage zone 1, creels for example, where the bobbins 2 of yarns 3 for constituting the core of the yarn to be made according to the invention are disposed. These yarns 3 are conducted via a delivery device 4, which may possibly be eliminated, to the treatment zone proper, generally designated by reference 5, where they will be coated and associated with discontinuous fibres.

This treatment zone 5 comprises a delivery device 6, a false twist spindle 7 of known type, for example a friction spindle with crossed belts.

A third intake delivery device 8 is disposed downstream of the spindle 7 and the yarn formed is wound at 9 by means of a conventional winding system which may or may not communicate an additional twist to the yarn formed.

The distribution of the discontinuous fibres about the core 3 is effected by providing, upstream of the false twist spindle 7, i.e. in the zone where the twist extends back, a mobile guiding surface 10 on which the fibres 11 are delivered tangentially and which tends to exert a pulling force on the free end of said fibres. These fibres 11 come from a rove 12 which undergoes a stretching, for example by means of a conventional system incorporating sleeves 13 or by a system of the selector type. With respect to the teaching of French Pat. No. 497481, according to the invention, the guiding surface 10 is of straight generatrix and presents a surface state ensuring maintenance of the fibres by simple contact. Furthermore, the fibres 11 are maintained paralleled, in the form of a band on the surface 10. Moreover, the core 3 is conducted tangentially to the surface 10 in a direction not only concurrent with the direction of delivery of the fibres 11 but also in secant fashion, tangentially to said flat rove 12. Finally, the twist communicated by the spindle 7 and which extends back on the guiding surface has a direction such that, in combination with the direction of advance of said guiding surface, the fibres are taken by the core 3 by passing beneath this core, i.e. their free end is imprisoned between the core and said guiding surface.

Figure 2:
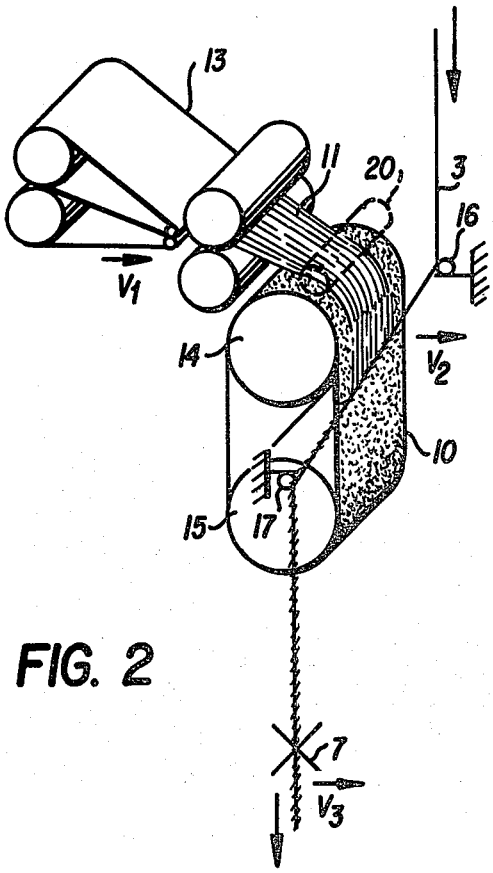
FIG. 2 is a view in perspective of a mobile guiding surface in the form of a belt, used for carrying out the process according to the invention.
Figure 3:
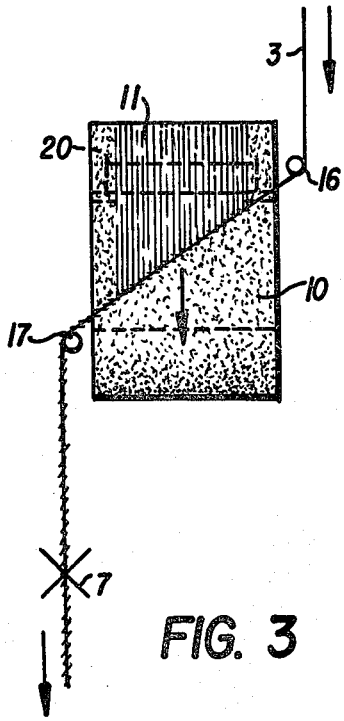
FIG. 3 is a front view of the guiding surface of FIG. 2, showing more precisely the core yarn/fibre bond on a guiding surface according to the invention.
Figure 7:
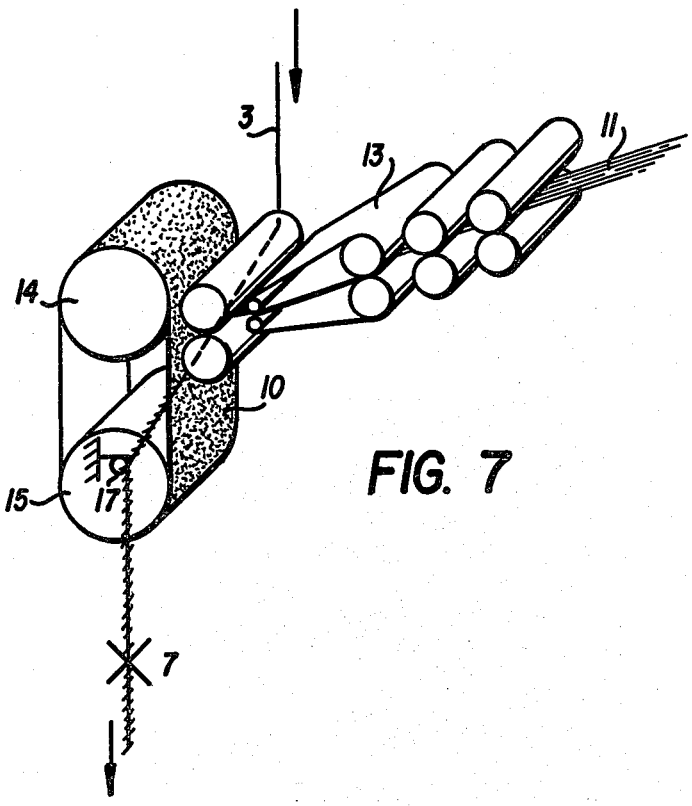
FIGS. 7 and 8 illustrate two other variants of a device according to the invention.

In the embodiment illustrated in FIGS. 2, 3 and 7, the guiding surface 10 is constituted by an endless belt supported by two rollers 14-15. In the example illustrated in FIG. 5, the guiding surface 10 is likewise constituted by an endless belt, but this belt is driven directly by the last cylinder of the stretching system.

Figure 4:
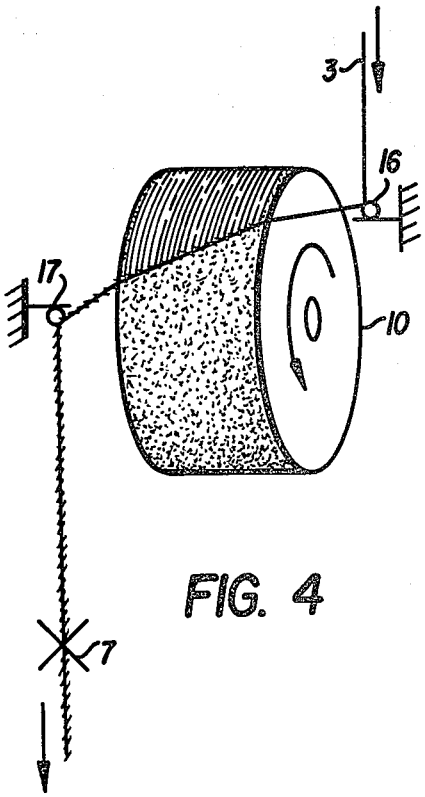
FIG. 4 illustrates a variant, likewise in perspective, of a guiding surface in the form of a drum which may be used for carrying out the invention.
Figure 8:
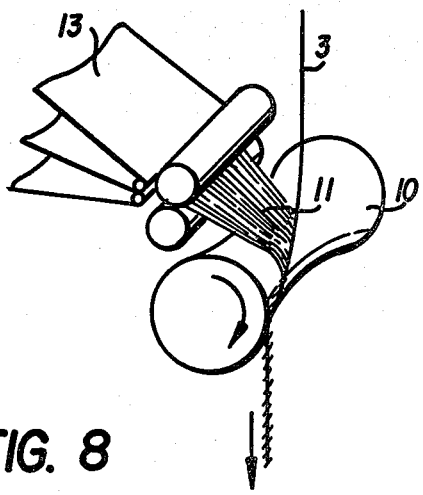

In the examples illustrated in FIGS. 4 and 8, the guiding surface is constituted by a rotating drum which is cylindrical in form in FIG. 4 and in the form of a hyperboloid in FIG. 8.

As is clearly shown in FIGS. 3, 4 and 7, guides 16 and 17 are preferably provided on each side of the guiding surface so that the core yarn 3 is presented tangentially to said surface and intersects the rove of fibres 11 over the whole of its width and obliquely in their direction of displacement.

Different types of materials may be used for the matter coating the guiding surface 10. It has been observed that good results were obtained by using as surface coating materials a textile material having the structure of a short-napped velvet. Such a material makes it possible to obtain good maintenance of the paralleled fibres 11 which, however, are easily detached from said surface upon passage of the core yarn 3, and distributed about this element.

Other types of materials may, of course, be used without departing from the scope of the invention.

For optimum working of the invention, it has been determined that the distance between the outlet of the last elements of the stretching system 13 and the point where the fibres of the rove 12 come into contact with the core, is preferably greater than the length of the fibres.

Furthermore, as far as the speeds of the different members with respect to one another are concerned, it has been observed that good results were obtained with a speed $V_2$ greater than or equal to speed $V_1$ of delivery of the fibres 11 on the guiding surface 10. $V_2$ is preferably of the order of 1.3 to 1.5 times $V_1$.

In the foregoing examples, it may be envisaged to use an additional presser roller, shown in chain-dotted lines in FIGS. 2, 3 and 4, designated by reference 20. This presser roller is disposed substantially in the zone where the fibres come into contact with the mobile surface and promotes hooking of the fibres on said surface.

Figure 5:
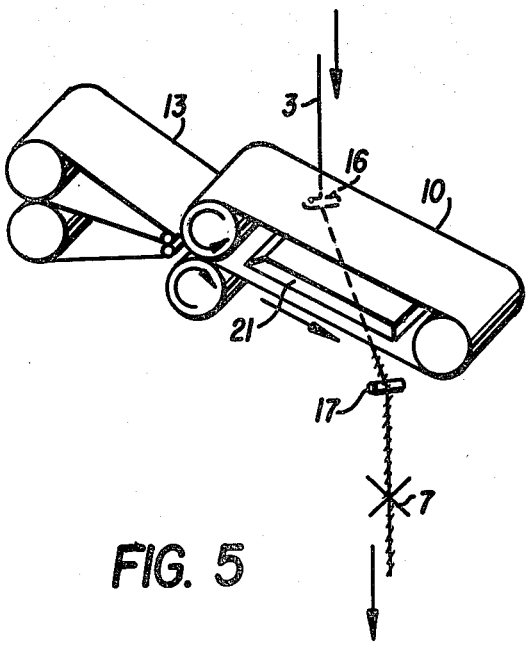
FIG. 5 illustrates another variant, likewise in perspective, of a guiding surface in the form of a belt associated with a suction system.

FIGS. 5 and 7 illustrate variants for carrying out the process according to the invention, using a conveyor belt 10 as guiding surface.

In these variants, the same references as those used for the example illustrated in FIGS. 2 and 3, are used for designating the same members.

In the embodiment according to FIG. 5, with respect to the example described in FIG. 2, the guiding surface 10 is also constituted by an endless belt, but is mounted directly around one of the cylinders driving the last pair of the stretching system 13. Consequently, the support roller 14 of FIG. 2 may be eliminated. In this embodiment, the fibres are delivered below the belt 10 and they are maintained on this surface by a suction system 21 disposed between the two sides of the belt. This belt must, of course, allow passage of air and may either be perforated or porous.

Such a variant is particularly suitable for treating cotton fibres, but this is, of course, not limiting.

In the variant illustrated in FIG. 8, the conveyor belt 10 is disposed vertically so that its rectilinear side is opposite the outlet cylinders of the stretching system. In this case, the fibres are distributed on this rectilinear side, their maintenance by the core 3 being effected as before by bringing this core tangentially to the surface, concurrently with the rove of fibres. This embodiment reduces to a minimum the distance between the outlet of the stretching system and the surface transporting the fibres.

Figure 6:
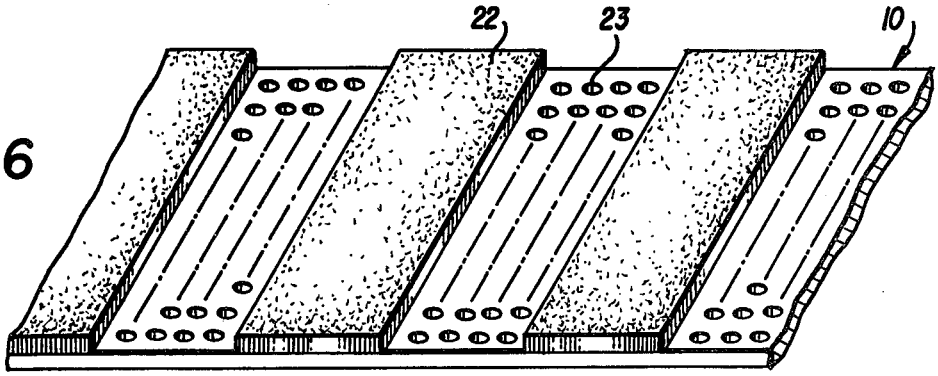
FIG. 6 is a partial schematic view in perspective showing a special guiding surface ensuring maintenance of the fibres by combination of a suction and a special surface state ensuring maintenance by simple contact.

If, in the foregoing examples, the fibres were maintained either by simple mutual contact of said fibres with the surface, or by the action of a phenomenon of suction on this surface, it may be envisaged, as illustrated in FIG. 6, to use as guiding surface a surface which combines a phenomenon of suction and a hooking of the fibres by simple mutual contact. In this case, a belt may for example be used which comprises alternating zones 22 of velvet type similar to that of FIG. 2 and perforated zones 23. It has been observed that good results were obtained with a length of perforated zone 23 shorter than the averge length of the fibres to be treated.

EXAMPLE 1

A core spun yarn according to the invention is made on an installation illustrated in FIG. 1, and comprising as guiding surface a rotating drum 10 of the type illustrated in FIG. 4, under the following conditions.

core yarn 3: polyester yarn of 167 Dtex,
rove of fibres 12: wool of 3300 Dtex-two ends-average length of the fibres: 120 mm,
stretching in 13: 18, 73;
count of the band after stretching: 356 Dtex
outlet speed $V_1$ of the rove 12: 50 m/min.
distance between the outlet of the stretching system 13 and the point of contact of the fibres 11 with the core 3: 240 mm,
width of the rove 12 on the drum 10: about 4 mm,
speed $V_2$ of the drum 10: 53 m/min.,
surface of the drum 10: short-napped velvet about 2 mm high
false twist spindle 7: spindle with crossed belts forming therebetween an angle of 48° having a linear speed of 185 m/min.,
tension of the core yarn: 30 to 35 gr.,
speed of winding ($V_3$): 48 m/min.

By proceeding in the manner mentioned above, a core spun yarn is obtained having a final count of 534 Dtex in which the wool fibres are perfectly distributed about the core 3 and which is very regular.

Such a yarn may be used as such in weaving or in hosiery.

EXAMPLE 2

Example 1 is repeated, but the guiding surface constituted by a drum is replaced by a guiding surface constituted by a flat belt as illustrated in FIGS. 2 and 3. As in Example 1, the belt is coated with a layer of short-napped velvet.

A yarn similar to that of Example 1 is obtained.

EXAMPLE 3

Example 1 is repeated, but the guiding surface constituted by a drum is replaced by a guiding surface constituted by a flat drum as illustrated in FIG. 5. This guiding surface is mounted on the upper driving roller of the last pair of stretching rollers of the stretching system 13.

Belt 10 is constituted by a perforated belt between the sides of which a suction box 21 is disposed.

The rove 12 is constituted by a rove of cotton of 30,000 Dtex stretched to 200 times in the system 13.

The operational conditions are as follows:

speed ($V_1$)=75 m/min., linear speed of the belt 10=100 m/min.

speed of passage of the core 3: 150 m/min.

core 3: spun yarn of polyester of 100 Dtex.

A core spun yarn is obtained in which the cotton fibres perfectly surround the internal core, this spun yarn having a count of 250 Dtex.

The invention is, of course, not limited to the embodiments described hereinabove, but it covers all the variants thereof made in the same spirit. It may for example be possible not only to make simple yarns but also assembled yarns.

Similarly, the guiding surfaces 10 may be constituted by elements other than drums or belts coated with a velvet.

What is claimed is:

1. A process for making a spun yarn of fibres comprising a core which consists in:

positively delivering a yarn intended to form the internal core, passing this yarn in tangential contact with a mobile guiding surface on which elementary fibres are maintained paralleled and flat, the yarn passing transversely with respect to said surface, communicating to said core yarn a twist which tends to extend back on the mobile surface supporting the elementary fibres, said process comprising the following steps of:

passing the core yarn on the paralleled fibres obliquely with respect to the surface and in the direction of displacement of the fibres, giving the twist communicated to the yarn by a false twist spindle, acting permanently on said yarn and which is disposed downstream of the mobile surface supporting the fibres.

2. The process of claim 1, wherein the fibres are maintained on the surface by simple mutual contact of the fibres with said surface.

3. The process of claim 1, wherein the fibres are maintained on the mobile guiding surface by creating a depression under said surface.

4. The process of claim 1, wherein the false twist communicated to the yarn is such that the fibres tend to wind around the core by passing beneath said core.

5. A device for carrying out the process of claim 1, comprising:

a storage zone, creels for example, where bobbins of yarn intended to constitute the core of the yarn to be produced are disposed, an intake delivery device of this core yarn, a mobile surface on which fibres are maintained paralleled and flat, guiding elements for passing the yarn transversely and tangentially with respect to the mobile guiding surface, a spindle communicating a torsion which tends to extend back on the mobile surface bearing the elementary fibres, wherein the means for guiding the yarn are disposed, with respect to the guiding surface, so that the passage of the core yarn on the paralleled fibres is effected obliquely with respect to the surface and in the displacement of the fibres, the twist communicated to the yarn is given by a false twist spindle acting permanently on said yarn, which spindle is disposed downstream of the mobile surface supporting the fibres.

6. The device of claim 5, wherein the guiding surface is in the form of a drum.

7. The device of claim 6, wherein the drum is cylindrical.

8. The device of claim 6, wherein the drum is in the form of a hyperboloid.

9. The device of claim 5, wherein the guiding surface is in the form of an endless belt.

10. The device of claim 5, wherein the guiding surface is coated with a material similar to a velvet.

11. The device of claim 5, wherein the guiding surface is constituted by a perforated surface subjected to a depression.

12. The device of claim 5, wherein the guiding surface is constituted by an endless belt mounted directly around one of the driving rollers of the last pair of rollers of a stretching system for a rove of fibres, said fibres being delivered beneath this endless belt and being maintained on this surface by a suction system disposed between the two sides of the belt.

* * * * *